US009121187B1

(12) United States Patent
Bunch et al.

(10) Patent No.: US 9,121,187 B1
(45) Date of Patent: Sep. 1, 2015

(54) TILE SPACING DEVICE AND ACCOMPANYING SYSTEM AND METHOD

(71) Applicants: Clinton D. Bunch, Sunnyvale, TX (US); Joshua A. Bunch, North Richland Hills, TX (US)

(72) Inventors: Clinton D. Bunch, Sunnyvale, TX (US); Joshua A. Bunch, North Richland Hills, TX (US)

( * ) Notice: Subject to any disclaimer, the term of this patent is extended or adjusted under 35 U.S.C. 154(b) by 0 days.

(21) Appl. No.: 14/630,312

(22) Filed: Feb. 24, 2015

(51) Int. Cl.

| | |
|---|---|
| ***E04F 21/20*** | (2006.01) |
| ***E04F 21/165*** | (2006.01) |
| ***G01D 21/00*** | (2006.01) |
| ***E04F 21/00*** | (2006.01) |
| ***E04F 21/18*** | (2006.01) |

(52) U.S. Cl.
CPC ..... *E04F 21/0092* (2013.01); *E04F 21/18* (2013.01)

(58) Field of Classification Search
CPC ..... E04F 21/0092; E04F 21/18; Y10S 33/20
USPC ..... 52/749.11, 677, 687, DIG. 1; 33/526, 33/527, 645, DIG. 20
See application file for complete search history.

(56) References Cited

U.S. PATENT DOCUMENTS

| | | | | |
|---|---|---|---|---|
| 5,201,130 | A * | 4/1993 | Krchnak | 33/526 |
| 5,288,534 | A | 2/1994 | Tavshanjian | |
| D492,210 | S | 6/2004 | Shilo et al. | |
| 6,769,191 | B1 | 8/2004 | Zusman | |
| 6,874,242 | B2 | 4/2005 | Shilo et al. | |
| 7,257,926 | B1 * | 8/2007 | Kirby | 52/126.5 |
| 7,536,802 | B1 | 5/2009 | Tavy et al. | |
| 7,698,831 | B2 | 4/2010 | Higgs et al. | |
| 8,205,348 | B2 | 6/2012 | Baros et al. | |
| 8,720,143 | B2 * | 5/2014 | Noutsis | 52/389 |
| 2004/0250435 | A1 * | 12/2004 | Fiore | 33/527 |
| 2005/0214502 | A1 * | 9/2005 | Westthorp | 428/98 |
| 2013/0212974 | A1 * | 8/2013 | Sullivan | 52/659 |

* cited by examiner

*Primary Examiner* — Robert Canfield
(74) *Attorney, Agent, or Firm* — Scott T. Griggs; Griggs Bergen LLP

(57) ABSTRACT

A tile spacing device and accompanying system and method are disclosed for spacing a plurality of tiles having a contour. In one embodiment, the tile spacing device includes two parallel bodies connected by at least one spanning member. The first body, the second body, and the at least one spanning member form a cage-like fused-member structure having a four-tile engagement configuration, a three-tile engagement configuration, and a two-tile engagement configuration, respectively. Within each of the three engagement configurations, engagement of a tile with a spacer can be seen by a user through the cage-like fused-member structure.

18 Claims, 2 Drawing Sheets

TILE SPACING DEVICE AND ACCOMPANYING SYSTEM AND METHOD

TECHNICAL FIELD OF THE INVENTION

This invention relates, in general, to tile installation and, in particular to a device for aligning tiles and properly spacing tiles during the installation thereof, and an accompanying system and method.

BACKGROUND OF THE INVENTION

Tile has become a popular decorative and functional article for use in floors, walls, countertops, and the like. Both professional tile installers and do-it-yourselfers spend a great deal of time aligning and spacing tiles as they are being placed on a substrate's surface. Proper alignment and spacing of each tile is important for a number of reasons. Improper installation can cause the need for tiles to be replaced in order to prevent a spacing error from propagating across the substrate, aesthetic reasons, and in some instances, safety concerns. A need exists for a device for aligning and properly spacing tiles.

SUMMARY OF THE INVENTION

It would be advantageous to achieve a device for aligning and properly spacing tiles. It would also be desirable to enable a mechanical-based solution that furnishes an inexpensive tool that assists professional tile installers and do-it-yourselfers. To better address one or more of these concerns, in one aspect of the invention, a tile spacing device and accompanying system and method are disclosed for spacing tiles are disclosed. In one embodiment of the tile spacing device two parallel bodies are connected by at least one spanning member. The first body, the second body, and the spanning member or spanning members form a cage-like fused-member structure having a four-tile engagement configuration, a three-tile engagement configuration, and a two-tile engagement configuration, respectively. Within each of the three engagement configurations, engagement of a tile with a spacer can be seen by a user through the cage-like fused-member structure. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
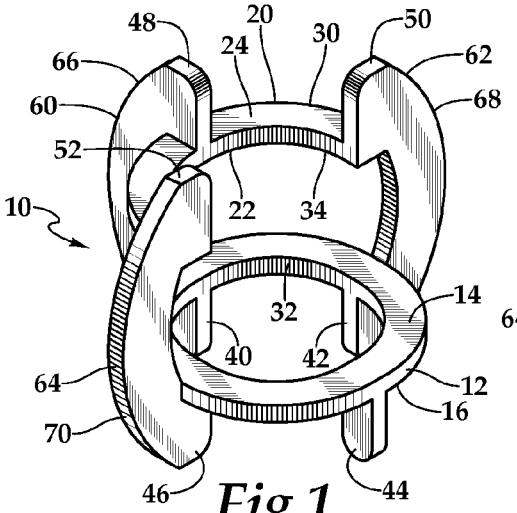
FIG. 1 is a front perspective view of one embodiment of a tile spacing device for spacing tiles according to the teachings presented herein.
Figure 2:
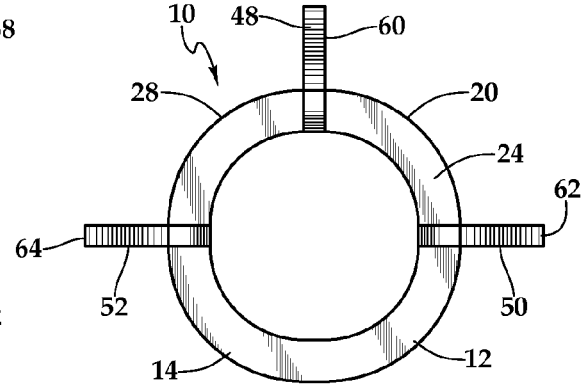
FIG. 2 is a top plan view showing the tile spacing device depicted in FIG. 1.
Figure 3:
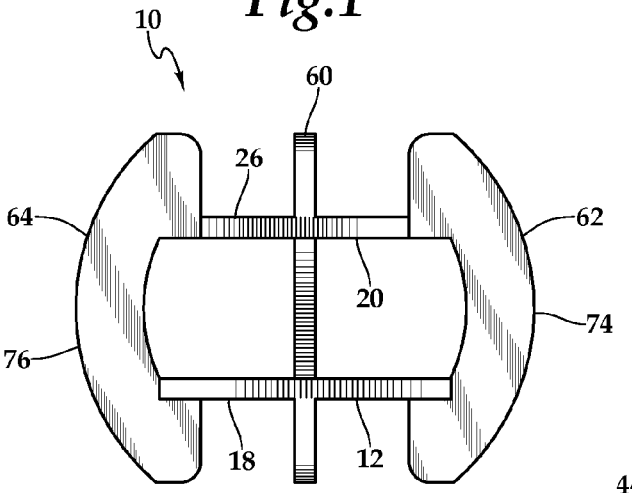
FIG. 3 is a rear elevation view showing the tile spacing device depicted in FIG. 1.
Figure 4:
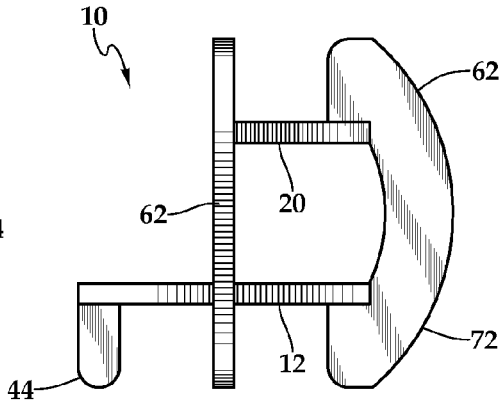
FIG. 4 is a left side view showing the tile spacing device depicted in FIG. 1.
Figure 5:
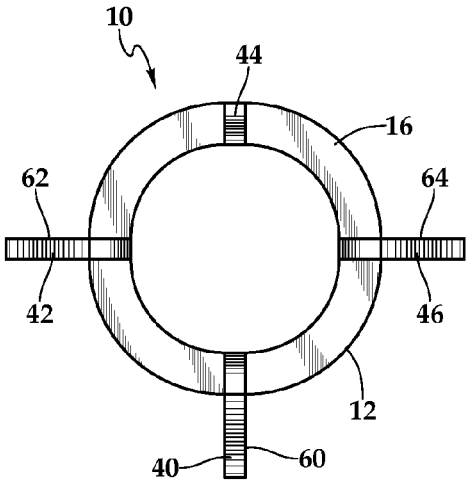
FIG. 5 is a bottom plan view showing the tile spacing device depicted in FIG. 1.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIG. 1 through FIG. 5, therein is depicted one embodiment of a tile spacing device that is schematically illustrated and generally designated 10. The tile spacing device 10 may be utilized for spacing tiles having a contour and the tile spacing device 10 includes a body 12 having an inner surface 14 and an outer surface 16. The outer surface 16 may have substantially the same contour 18 as the tiles such that the outer surface 16 compliments the tiles in a surface-to-surface engagement. A body 20 has an inner surface 22 and an outer surface 24 and, similar to the outer surface 16, the outer surface 24 has substantially the same contour 26 as the tiles. As shown, the body 12 is located in a spaced relationship with the body 20. In the illustrated implementation, the body 12 may be a circular ring 28 and the body 20 may be a semi-circular ring 30, with the circular ring 28 and the semi-circular ring 30 being substantially parallel and concentric. With this arrangement, a window 32 is located at the circular ring 28 and a window 34 is located at the semi-circular ring 30 to provide visibility therethrough.

In one embodiment, four spacers 40, 42, 44, 46 are disposed on and extend from the outer surface 16 of the body 12. Each of the spacers 40, 42, 44, 46 are configured to engage tiles and the four spacers 40, 42, 44, 46, in combination, cooperate to engage four tiles simultaneously. In one implementation, the spacers 40, 42, 44, 46 are spaced at approximately 0, 90, 180, and 270 degrees with respect to each other. With respect to the body 20, three spacers 48, 50, 52 are disposed on and extend from the outer surface 24 of the body 20. Similar to the spacers 40, 42, 44, 46, each of the three spacers 48, 50, 52 may be configured to engage tiles such that the three spacers 48, 50, 52, in combination, cooperate to engage three tiles. In one implementation, the spacers 48, 50, 52 are spaced at approximately 0, 90, and 270 degrees with respect to each other.

Spanning members 60, 62, 64 traverse a span between the body 12 and the body 20 and are connected to the body 12 and the body 20. Each spanning member 60, 62, 64 includes a spacer, respectively 66, 68, 70, located along a respective edge 72, 74, 76 thereof and each of the spacers 66, 68, 70 is configured to engage two tiles. Moreover, in one embodiment, each of the three spanning members 60, 62, corresponds to and is integral with three of the four spacers 40, 42, 46 extending form the outer surface 16 of the body 12. Further, each of the three spanning members 60, 62, 64 correspond to and is integral with the three spacers 48, 50, 52 extending from the outer surface 24 of the body 20. With this configuration the spanning members 60, 62, 64 serve multiple purposes. The spanning members 60, 62, 64 provide for two-tile engagement, provide a framework and structure for connecting the body 12 and the body 20, and serve as the spacers 40, 42, 46, 48, 50, and 52. Further, the spanning members 60, 62, 64 may have an arcuate profile (see FIGS. 3 and 4) or may have a different profile such as rectangular or straight profile.

It should be appreciated that the tile spacing device 10 is not limited to use with floor tiles. As used herein, the tiles may be traditional thin rectangular slabs of baked clay, concrete, or other material for covering floors or, more generally, substrates of any material including wood, finishing boards, or metal or the like used to cover a substrate, such as a horizontal surface or a vertical surface, such as a wall.

Figure 6A:
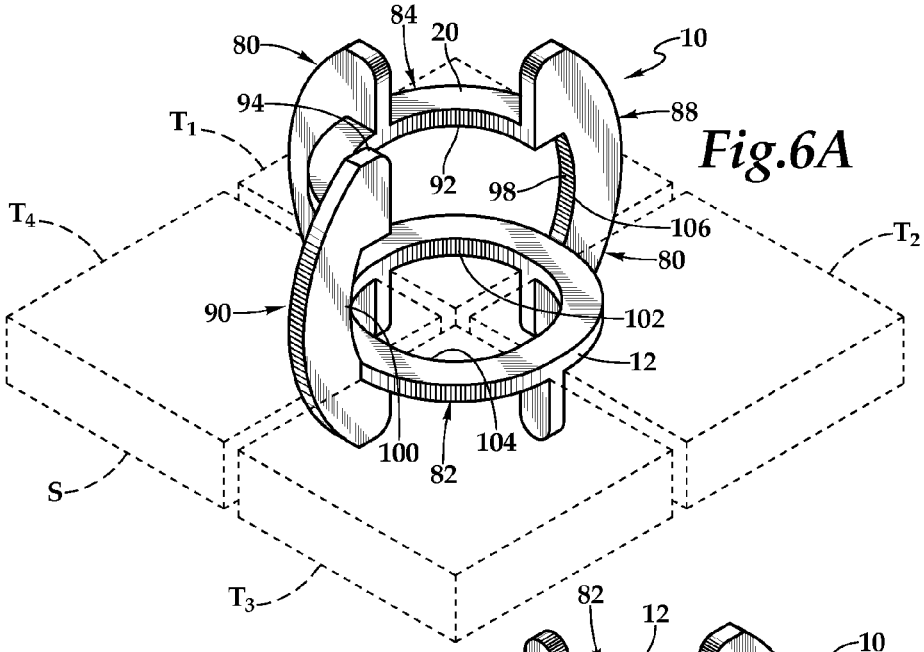
FIG. 6A is a front elevation view of one embodiment of the tile spacing device being utilized to align and space four tiles.
Figure 6B:
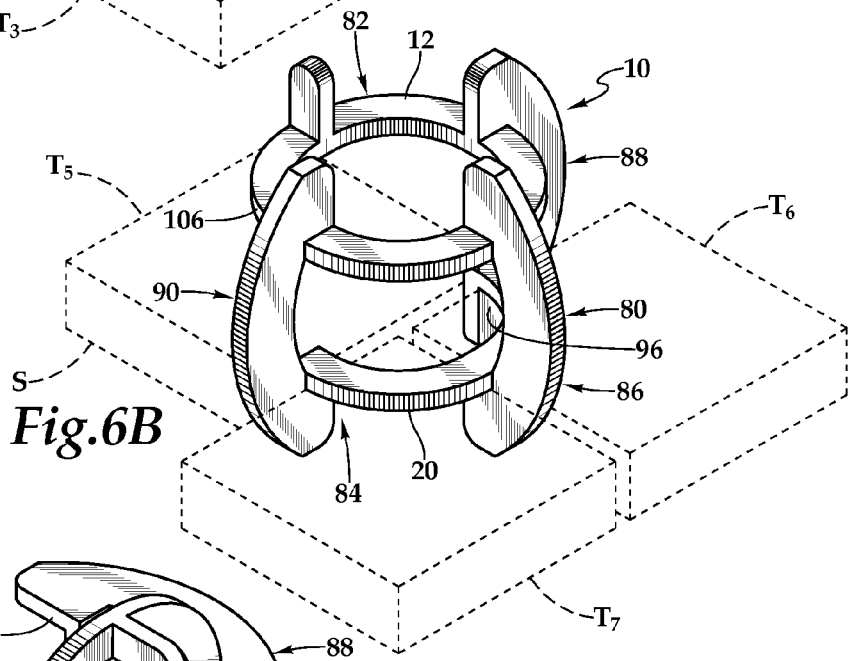
FIG. 6B is a front elevation view of one embodiment of the tile spacing device being utilized to align and space three tiles.
Figure 6C:
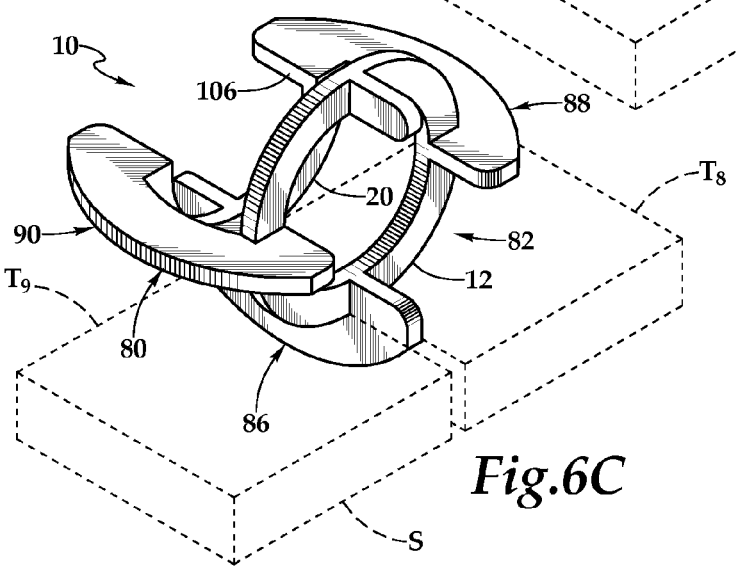
FIG. 6C is a front elevation view of one embodiment of the tile spacing device being utilized to align and space three tiles.

Referring now to FIGS. 6A, 6B, and 6C, the body 12, the body 20, and the spanning members 60, 62, 64 of the tile spacing device 10 form a cage-like fused-member structure 80 having a four-tile engagement configuration 82, a three-tile engagement configuration 84, and a two-tile engagement configuration 86, 88, 90. In one embodiment, within each of the three engagement configurations 82 through 90, the engagement of a tile with a spacer can be seen by a user through the cage-like fused-member structure 80. The cage-like fused-member structure 80 provides an openness to the design that not only provides visibility into the work area but gripping surfaces as well for easy removal. Moreover, within each of the three engagement configurations 82 through 90, the cage-like fused-member structure 80 provides subterminal opposition surfaces, including surfaces 92, 94, 96, 98, 100, and 102, in which the palmar surfaces of the thumb and index finger hold the tile spacing device therebetween. The subterminal opposition surfaces 92 through 102 provide the length and breadth required for gripping the spacing device 10 for insertion and removal during a tile spacing and alignment. As can be seen with reference to FIG. 6A, FIG. 6B, and FIG. 6C, with a rotation of the tile spacing device 10, alignment and spacing of two, three or four tiles may be achieved.

In operation, the cage-like fused-member structure 80 of the tile spacing device 10 permits the user to view the intersection (or corner intersection) of the two, three, or four tiles being placed such that proper alignment and spacing of the tiles may be checked and improved to approach industry exactness. Further, the cage-like fused-member structure 80 aids in tile alignment as well as ensuring flushness and mitigation of gaps as the circular ring 28 and semi-circular ring 30 are designed to touch tiles in a substantially singular plane. As alluded, once the tiles are aligned, the fused-member structure may be easily removed without the need for pliers or other tools.

Figure 7:
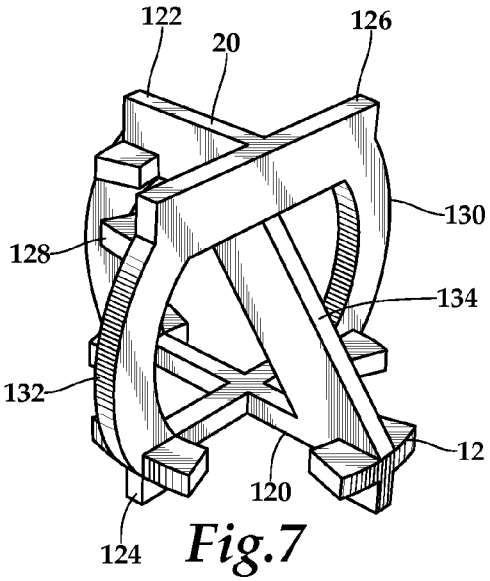
FIG. 7 depicts a front elevation view of another embodiment of a tile spacing device being utilized to align and space tiles.

Referring now to FIG. 7, wherein another embodiment of the tile spacing device is illustrated. In this embodiment, the body 12 may be a plus (+)-shaped body 120 and the body 20 may be a T-shaped body 122 such that the body 12 and the body 20 are substantially parallel. In this implementation, the four spacers, which are collectively depicted by element 124, may be substantially continuous with the body 12 and, similarly the three spacers, which are collectively depicted by element 126, may be substantially continuous with the body 20. As shown, multiple spanning members 128, 130, 132 may be utilized or, in one embodiment, at least one bridge member 134 may connect the body 12 to the body 20. In a bridge-member implementation, the bridge member 134 may not have the spacer functionality of a spanning member.

As discussed, both professional tile installers and do-it-yourselfers spend a great deal of time aligning and leveling tiles as they are being placed on a substrate's surface. Proper alignment and leveling of each tile is important for a number of reasons. Improper installation can cause the need for tiles to be replaced in order to prevent a spacing error from propagating across the substrate, aesthetic reasons, and in some instances, safety concerns. The tile spacing device and teachings presented herein provide a single spacing device that with a simple rotation of the device can be used to align and space two, three or four tiles.

The order of execution or performance of the methods and steps illustrated and described herein is not essential, unless otherwise specified. That is, elements of the methods and steps may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tile spacing device for spacing a plurality of tiles having a contour, the tile spacing device comprising:

a first body having a first inner surface and a first outer surface, the first outer surface having substantially the same contour as the plurality of tiles;

a second body having a second inner surface and a second outer surface, the second outer surface having substantially the same contour as the plurality of tiles, the second body being in a spaced relationship with the first body;

four spacers disposed on and extending from or substantially continuous with the first outer surface of the first body, each of the four spacers being configured to engage tiles;

the four spacers, in combination, cooperating to engage four tiles;

three spacers disposed on and extending from or substantially continuous with the second outer surface of the second body, each of the three spacers being configured to engage tiles;

the three spacers, in combination, cooperating to engage three tiles;

at least one spanning member traversing a span between the first body and the second body, the spanning member being connected to the first body and the second body, the spanning member including a spacer located along an edge thereof, the spacer configured to engage two tiles; and the first body, the second body, and the at least one spanning member forming a cage-like fused-member structure having a two-tile engagement configuration, a three-tile engagement configuration, and a four-tile engagement configuration, wherein, within each of the three engagement configurations, the engagement of a tile with a spacer can be seen by a user through the cage-like fused-member structure, wherein, within each of the three engagement configurations, the cage-like fused-member structure provides subterminal opposition surfaces in which the palmar surfaces of the thumb and index finger can hold the tile spacing device therebetween.

2. The tile spacing device as recited in claim 1, wherein the first body further comprises a circular ring.

3. The tile spacing device as recited in claim 1, wherein the second body further comprises a semi-circular ring.

4. The tile spacing device as recited in claim 1, wherein the first body further comprises a circular ring and the second body further comprises a semi-circular ring.

5. The tile spacing device as recited in claim 1, wherein the first body and the second body are substantially parallel and concentric.

6. The tile spacing device as recited in claim 1, wherein the at least one spanning member further comprises three spanning members, each of the three spanning members corresponding to and being integral with three of the four spacers extending form the first outer surface, each of the three spanning members corresponding to and being integral with the three spacers extending from the second outer surface.

7. The tile spacing device as recited in claim 1, wherein the first body and the second body each further comprises a window therethrough.

8. The tile spacing device as recited in claim 1, wherein the first body further comprises a plus (+)-shaped body.

9. The tile spacing device as recited in claim 1, wherein the second body comprises a T-shaped body.

10. The tile spacing device as recited in claim 1, wherein the first body further comprises a plus (+)-shaped body having the four spacers substantially continuous therealong, and the second body further comprises a T-shaped body having the three spacers substantially continuous therealong.

11. The tile spacing device as recited in claim 1, wherein the at least one spanning member further comprises three spanning members, each of the spanning members being connected to the first body and the second body, each of the spanning members including a spacer located along an edge thereof, each of the spacers configured to engage two tiles.

12. The tile spacing device as recited in claim 1, further comprising at least one bridge member connected to the first body and the second body.

13. The tile spacing device as recited in claim 1, wherein the four spacers are spaced at approximately 0, 90, 180, and 270 degrees with respect to each other.

14. The tile spacing device as recited in claim 1, wherein the three spacers are spaced at approximately 0, 90, and 270 degrees with respect to each other.

15. A tile spacing device for spacing a plurality of tiles having a contour, the tile spacing device comprising:

a first body having a first inner surface and a first outer surface, the first outer surface having substantially the same contour as the plurality of tiles;

a second body having a second inner surface and a second outer surface, the second outer surface having substantially the same contour as the plurality of tiles, the second body being in a spaced relationship with the first body;

the first body and second body being substantially parallel;

four spacers disposed on and extending from or substantially continuous with the first outer surface of the first body, the four spacers being spaced at approximately 0, 90, 180, and 270 degrees with respect to each other, each of the four spacers being configured to engage tiles;

the four spacers, in combination, cooperating to engage four tiles;

three spacers disposed on and extending from or substantially continuous with the second outer surface of the second body, the three spacers being spaced at approximately 0, 90, and 270 degrees with respect to each other, each of the three spacers being configured to engage tiles;

the three spacers, in combination, cooperating to engage three tiles;

at least one spanning member traversing a span between the first body and the second body, the spanning member being connected to the first body and the second body, the spanning member including a spacer located along an edge thereof, the spacer configured to engage two tiles; and the first body, the second body, and the at least one spanning member forming a cage-like fused-member structure having a two-tile engagement configuration, a three-tile engagement configuration, and a four-tile engagement configuration, wherein, within each of the three engagement configurations, the engagement of a tile with a spacer can be seen by a user through the cage-like fused-member structure.

16. The tile spacing device as recited in claim 15, wherein the at least one spanning member further comprises three spanning members, each of the spanning members being connected to the first body and the second body, each of the spanning members including a spacer located along an edge thereof, each of the spacers configured to engage two tiles.

17. The tile spacing device as recited in claim 15, further comprising at least one bridge member connected to the first body and the second body.

18. A tile spacing device for spacing a plurality of tiles having a contour, the tile spacing device comprising:

a first body having a first inner surface and a first outer surface, the first outer surface having substantially the same contour as the plurality of tiles;

a second body having a second inner surface and a second outer surface, the second outer surface having substantially the same contour as the plurality of tiles, the second body being in a spaced relationship with the first body;

the first body and second body being substantially parallel;

four spacers disposed on and extending from or substantially continuous with the first outer surface of the first body, the four spacers being spaced at approximately 0, 90, 180, and 270 degrees with respect to each other, each of the four spacers being configured to engage tiles;

the four spacers, in combination, cooperating to engage four tiles;

three spacers disposed on and extending from or substantially continuous with the second outer surface of the second body, the three spacers being spaced at approximately 0, 90, and 270 degrees with respect to each other, each of the three spacers being configured to engage tiles;

the three spacers, in combination, cooperating to engage three tiles;

three spanning members each traversing a span between the first body and the second body, each of the three spanning members being connected to the first body and the second body, each of the three the spanning members including a spacer located along an edge thereof, the spacer configured to engage two tiles; and the first body, the second body, and the at least one spanning member forming a cage-like fused-member structure having a two-tile engagement configuration, a three-tile engagement configuration, and a four-tile engagement configuration, wherein, within each of the three engagement configurations, the engagement of a tile with a spacer can be seen by a user through the cage-like fused-member structure, wherein, within each of the three engagement configurations, the cage-like fused-member structure provides subterminal opposition surfaces in which the palmar surfaces of the thumb and index finger can hold the tile spacing device therebetween.

* * * * *